United States Patent [19]

Leinfelt

[11] 4,070,170

[45] Jan. 24, 1978

[54] COMBINATION DUST CONTAINER FOR VACUUM CLEANER AND SIGNALLING DEVICE

[75] Inventor: Karl Eric Leinfelt, Stockholm, Sweden

[73] Assignee: Aktiebolaget Electrolux, Sweden

[21] Appl. No.: 715,340

[22] Filed: Aug. 18, 1976

[30] Foreign Application Priority Data

Aug. 20, 1975 Sweden ..... 7509298

[51] Int. Cl.[2] ..... B01D 46/04; G01L 19/12

[52] U.S. Cl. ..... 55/274; 15/DIG. 339; 55/DIG. 34; 116/114 AD

[58] Field of Search ..... 116/114 AD, 114 PV, 116/DIG. 25; 55/274, DIG. 34; 15/339, DIG. 11; 73/419, 396

[56] References Cited

U.S. PATENT DOCUMENTS

| | | | |
|---|---|---|---|
| 2,325,188 | 7/1943 | Lofgren | 116/114 AD X |
| 3,119,369 | 1/1964 | Harland et al. | 116/114 PV |
| 3,392,906 | 7/1968 | Fesco | 55/274 |
| 3,587,515 | 6/1971 | Anderson | 55/274 X |
| 3,678,882 | 7/1972 | Kinsella | 116/114 PV X |
| 4,020,784 | 3/1977 | Greene | 116/114 PV |

FOREIGN PATENT DOCUMENTS

| | | | |
|---|---|---|---|
| 669,291 | 4/1952 | United Kingdom | 73/396 |

*Primary Examiner*—Daniel M. Yasich
*Attorney, Agent, or Firm*—Alfred E. Miller

[57] ABSTRACT

A combination dust container or bag for a vacuum cleaner and a signal indicator for alerting the user to the replacement of the dust bag. The communication between the interior of the dust bag and the signal indicator includes an air pervious part integral with the dust bag. The signal indicator also communicates with the enclosed area between the exterior of the dust bag and the interior of the vacuum cleaner housing. Furthermore, the signal indicator has a member which is movable therein as a result of the pressure difference between the interior and exterior of the dust bag.

4 Claims, 3 Drawing Figures

COMBINATION DUST CONTAINER FOR VACUUM CLEANER AND SIGNALLING DEVICE

BACKGROUND OF THE INVENTION

It is well known that vacuum cleaner bags or containers become filled upon use and require replacement from time to time. In order to increase the efficiency of the vacuum cleaner it is disirable to know when the bag needs replacing. Furthermore, damage to the vacuum cleaner motor is prevented inasmuch as the motors are generally dependent upon the air flow present in the vacuum cleaner housing for cooling.

In order to alert the vacuum cleaner user to the fact that the bag requires replacement, signal devices have been previously used which are dependent upon the pressure differences prevailing between the inlet and the outlet of the dust container. This pressure difference is used to move a member, such as a piston in a cylinder, that is visible from the exterior of the apparatus. Thus, when the dust bag is filled the piston has been moved to such a position indicating that the vacuum cleaner bag replacement is necessary.

The above-described construction has a serious drawback in that the interior of the signalling devices employed become contaminated by a reason of the airborne particles passing therethrough. This situation occurs since there is a higher absolute pressure inside the dust container and in spite of the use of seals the dust particles are capable of finding their way through the space between the outer surface of the piston and the inner surface of the cylinder to the other end of the piston where a lower absolute pressure is in existence. It will be evident that some dirt particles may adhere in the confined space between the piston and cylinder and thereby jeopardize the correct operation of the signal device by failing to indicate, at the proper time, the need for a bag replacement.

In previously known signal devices for vacuum cleaners a filter is provided in the channel connecting the interior of the dust container to the signal device. However, a serious drawback has arisen since the filter must be changed at regular intervals in order to ensure a reliable indication or simply the general operation of the signal device.

It is an object of the present invention to overcome the above-mentioned serious disadvantage and to provide a construction that prevents dust and dirt particles present in the interior of the dust container from penetrating into the components of the signalling device by eliminating a filter device and utilizing a communicating means in the attachment plate of a vacuum cleaner bag in which a first air channel is formed which communicates the dust container to the signalling device with a part of the dust container functioning as an air pervious member in the air flow path.

In order that the invention will be more clearly understood, it will now be disclosed in greater detail with reference to the accompanying drawings, in which:

FIG. 1 is a diagrammatic view of a dust container or bag for a vacuum cleaner having a signalling device constructed in accordance with the teachings of the present invention which is connected to the interior and exterior of the dust container respectively, FIG. 2 is an exploded perspective view of the dust container or bag showing the attachment plate separated from the dust bag, and FIG. 3 is a sectional view on an enlarged scale of a detail of construction shown in FIG. 1.

DESCRIPTION OF THE PREFERRED EMBODIMENT OF THE INVENTION

Figure 1:
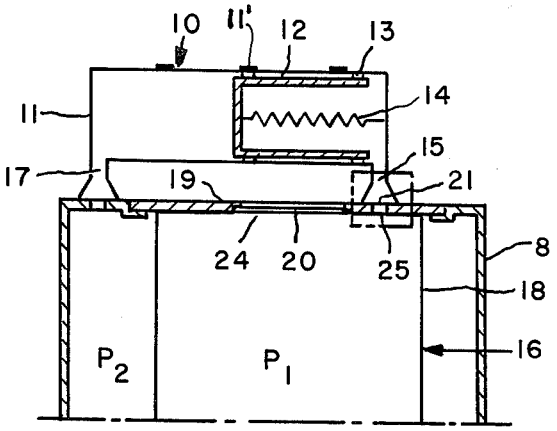

As seen in FIG. 1 the dust container or bag is referred to generally by the numeral 16 and it is shown in position within the vacuum cleaner housing 8. The signalling device or dust indicator is referred to generally by the numeral 10 and comprises a cylinder 11 fabricated of a transparent material, such as a clear plastic. The cylinder 11 is provided with a piston 12 which is movable therein. Annular seals 13 are provided at both ends of the piston 12. As seen in FIG. 1, a spring 14 is secured to the piston 12 at one end and the cylinder body at the other end. The spring 14 normally urges the piston 12 to the initial position as shown in FIG. 1. The movement of the piston 12 can be easily visible through the transparent cylinder body 11, as well as a transparent sight glass in the cover (not shown) in the vacuum cleaner housing 8. The sight glass closes the signal device and the suction end of the vacuum cleaner. Additionally, the exterior of the piston 12 is provided with markings 11' for example, figures or other symbols to indicate the amount of dirt in the vacuum cleaner bag or container at any given time.

It is seen particularly in FIG. 1 the right hand end of the cylinder 11 communicates by means of a first channel 15 with the space in the interior of the dust container 16 in which a pressure P1 prevails. The opposite left hand end of the cylinder 11 is provided with a channel 17 which communicates with the outside of the dust container or bag 16 in which the absolute pressure P2 prevails. Thus, measured in absolute values P1 is larger than P2, therefore, the piston 12 moves to the left in FIG. 1 against the action of the spring 14. Therefore, the piston 12 is subject to the pressure difference which in turn is dependent on the difference in pressure between the interior and exterior of the dust container (P1-P2).

Figure 3:
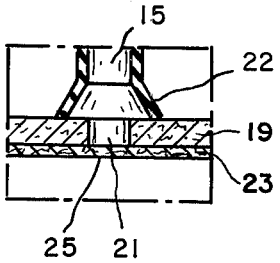
Figure 2:
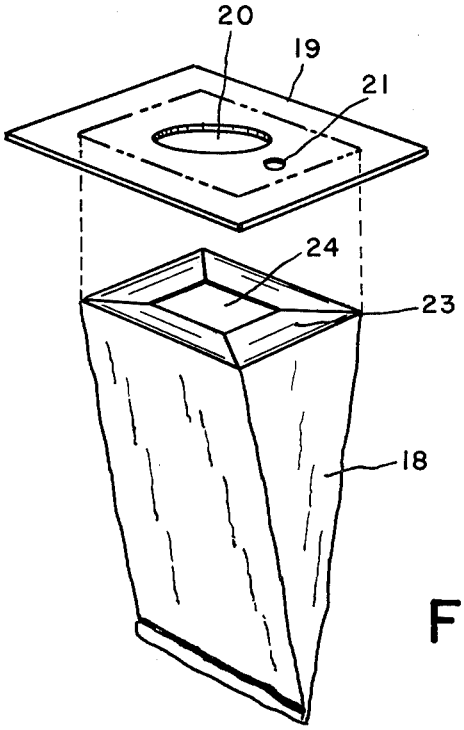

The dust container or bag 16 includes an air pervious part 18 together with a portion 23 thereof which is joined to the attachment plate 19. The latter is fabricated of relatively rigid material and has a central inlet opening 20 for receiving dust laden air therethrough. Furthermore, the attachment plate 19 is provided with a through hole 21 (FIG. 2) through which the channel 15 communicates with the interior of the dust container 16. As seen in FIG. 3 one end of the channel 15 is provided with a frustro-conical section 22, for example, constituted of rubber, which when the cover of the housing is closed seals around the hole 21 on the top surface of the attachment plate 19. Referring to FIG. 2, the air pervious part 18, as stated above, is provided with a portion 23 folded toward the inlet opening 20 which forms a relatively rectangular opening 24. The portion 23 serves as an abutment surface of the air pervious part to the attachment plate 19. In order to make the dust container or bag 16 rotatable through a 180° with regards to it position in a dust collecting space the attachment plate 19 may optionally have an additional hole (not shown) disposed symmetrically relative to the center of the inlet opening. It should be noted that the hole 21 may be circular or may have any other cross-sectional area which is suitable for its purpose.

In order to manufacture the dust container or bag 16 in accordance with the principles of the present invention, one preceeds in the following manner:

The attachment plate 19 and the inlet opening 20 and hole 21 are punched out. Thereafter, the air pervious part 18 of the dust container 16 is made and its open end is folded to form the portion 23 to subsequently abut the underside of the attachment plate 19. An adhesive material such as glue is applied to one surface of the attachment plate 19 and the folded portion 23 is thereby joined to the undersurface of the attachment plate 19. Thus, by applying glue or ther adhesive to the attachment plate 19 after the inlet opening 20 and the hole 21 have been punched and by disposing the hole 21 adjacent to the abutment surface of the portion 23 to the attachment plate 19 as seen in FIG. 1, a filter section 25 is formed inside the dust container 16 and immediately below the hole 21. The filter thus fabricated from the dust container 16 prevents dust or dirt particles from entering the cylinder 11 by means of the channel 15. Otherwise, if dirt and dust particles were present therein the friction of the piston 12 against the interior walls of the cylinder 11 would increase to a point that incorrect readings would appear on the signalling device. An additional advantage of the present arrangement is that each time the dust container 16 is replaced a new filter section 25 of piston 23 is inserted in the vacuum cleaner housing. The latter has the desirable result of an increased guarantee of the safe operation of the signalling device for a vacuum cleaner. It is therefore considered that the present instruction is a distinct improvement over previously known signalling devices for changing of vacuum cleaner dirt or dust containers.

What is claimed is:

1. A combination of a vacuum cleaner, dust container and a signalling device for indicating the amount of dust and dirt filling in said dust container comprising: said dust container having a relatively rigid attachment plate and an air pervious part secured thereto, said attachment plate having an inlet opening for dust laden air, said signalling device having at least a partially transparent cylinder, a member in said cylinder, a first channel communicating one end of the cylinder with the interior of said dust container through the air pervious part of said attachment plate, a second channel communicating the other end of said cylinder with a location at the exterior of said dust container, said member being movable in said cylinder by the action of the pressure difference between the interior and exterior of said dust container, series of markings visible on the exterior of said vacuum cleaner relative to said member which visually indicate the amount of filling of said dust container at any given time, said attachment plate having at least one through hole through which said first air channel communicates with the interior of said dust container, said through hole being spaced from the inlet opening in said attachment plate, and a portion of said air pervious part being in the air flow path from the interior of said dust container to said first channel, said portion of the air pervious part of the dust containter being folded inwardly toward said inlet opening, said hole being located above said folded-in portion, and said portion forming an abutment surface with the undersurface of said attachment plate.

2. A combination as claimed in claim 1 wherein said hole is circular in cross section.

3. A combination as claimed in claim 1 wherein at least said first channel is provided with a frustro-conical end portion that is adapted to abut the top surface of said attachment plate and is co-axially aligned with said through hole when said signalling device is in the operative position.

4. A combination as claimed in claim 3 wherein said frustro-conical end portion is a resilient material that forms a seal around said through hole.

* * * * *